US005431387A

United States Patent [19]

Loben et al.

[11] Patent Number: 5,431,387

[45] Date of Patent: Jul. 11, 1995

[54] METHOD AND APPARATUS FOR A RECIPROCATING A TABLE IN RESPONSE TO ECCENTRICALLY MOUNTED CAM

[75] Inventors: Rudy E. Loben; John A. Long, both of Scarborough, Canada

[73] Assignee: Longford Equipment International Limited, Ontario, Canada

[21] Appl. No.: 205,926

[22] Filed: Mar. 3, 1994

[51] Int. Cl.[6] ..... B64H 31/04

[52] U.S. Cl. ..... 271/213; 414/790.5

[58] Field of Search ..... 271/213, 214, 215; 414/790.6, 790.5, 791.2

[56] References Cited

U.S. PATENT DOCUMENTS

| | | | |
|---|---|---|---|
| 2,414,059 | 1/1947 | Powers | 414/790.6 |
| 3,272,160 | 9/1966 | Atkins et al. | 414/790.5 X |
| 5,037,081 | 8/1991 | Engelhardt et al. | 271/213 X |
| 5,173,785 | 12/1992 | Muramatsu | 271/213 X |

FOREIGN PATENT DOCUMENTS

| | | | |
|---|---|---|---|
| 2028775 | 3/1980 | United Kingdom | 414/790.6 |

*Primary Examiner*—Cheryl L. Gastineau
*Assistant Examiner*—Boris Milef
*Attorney, Agent, or Firm*—Dykema Gossett

[57] ABSTRACT

A reciprocating table has a cam follower in the nature of an elongate slot extending transversely of the reciprocating path of the table. This slot receives a cam which is eccentrically mounted on a cam support wheel. The angular position of the cam support wheel is monitored by a rotary encoder and the cam wheel is driven by a bi-directional motor under microprocessor control. The microprocessor controls the motion of the cam such that an angular quadrant centred about the position of the cam defining the most extended position of the table is not used since the table is relatively insensitive to the motion of the cam within this quadrant. In contrast, the opposite quadrant extending about the most retracted position of the table is utilized so that the cam may be moved quickly to retract the table and yet the table is naturally decelerated.

6 Claims, 3 Drawing Sheets

METHOD AND APPARATUS FOR A RECIPROCATING A TABLE IN RESPONSE TO ECCENTRICALLY MOUNTED CAM

BACKGROUND OF THE INVENTION

1. Field of the Invention

This invention relates to a reciprocating table and to a method of reciprocating a table.

2. Description of the Related Art

In a number of cut sheet and card stock handling applications, it is desired to accumulate a stack of fed cards or sheets on a table. Once the desired number of cards or sheets have been accumulated, the table may retract to drop the stack onto a downstream machine.

It is known to use an air cylinder to extend and retract a reciprocating table. With such an arrangement, on cue, air pressure is communicated to one side of the air cylinder to extend the table and, again on cue, air pressure is communicated to the other side of the cylinder to retract the table. There may be moisture in the valving controlling the air cylinder or in the air cylinder itself which would slow operation. Accordingly, it is necessary to pause the machinery feeding cards or sheets to the table for a sufficient time to ensure that the table has first fully retracted, dropping the stack and then for a sufficient additional time to ensure the table has once more extended so as to be in a position to receive additional cards or sheets. The need to incorporate this delay into the operation of a machine utilizing such a reciprocating table slows production.

The present invention seeks to overcome drawbacks of the known prior art.

SUMMARY OF THE INVENTION

According to the present invention, there is provided a reciprocating table comprising table guides for guiding said table in a linear path for reciprocation; a cam support mounted for rotation in a plane parallel to said linear path; a cam eccentrically mounted to said rotatable cam support; a cam follower carried by said table extending transversely of said linear path; means to selectively rotate said cam support for selectively extending and retracting said reciprocating table; and a stripper associated with said table into which said table retracts.

In accordance with another aspect of this invention there is provided a method of reciprocating a table having table guides for guiding said table for reciprocation in a linear path; a cam support for rotating in a plane parallel to said linear path; a cam eccentrically mounted to said rotatable cam support; and a cam follower carried by said table extending transversely of said linear path, comprising the steps of when said cam is in a first quadrant whereat said table is relatively insensitive to motion of said cam and including the position of said cam which defines the most retracted position of said table, selectively extending said table by rotating said cam support in a first sense such that said cam moves from said first quadrant to a position whereat said cam has passed a midway point between said rotational position of said cam defining the most retracted position of said table and a rotational position defining the most extended position of said table and has approached, but has not reached, a second quadrant whereat said table is relatively insensitive to motion of said cam and including the position of said cam which defines the most extended position of said table; and selectively retracting said table by rotating said cam in a second sense opposite said first sense from said second quadrant approaching position to a position anywhere within said first quadrant.

BRIEF DESCRIPTION OF THE DRAWINGS

In the figures which disclose example embodiments of the invention.

DESCRIPTION OF THE PREFERRED EMBODIMENTS

Figure 1:
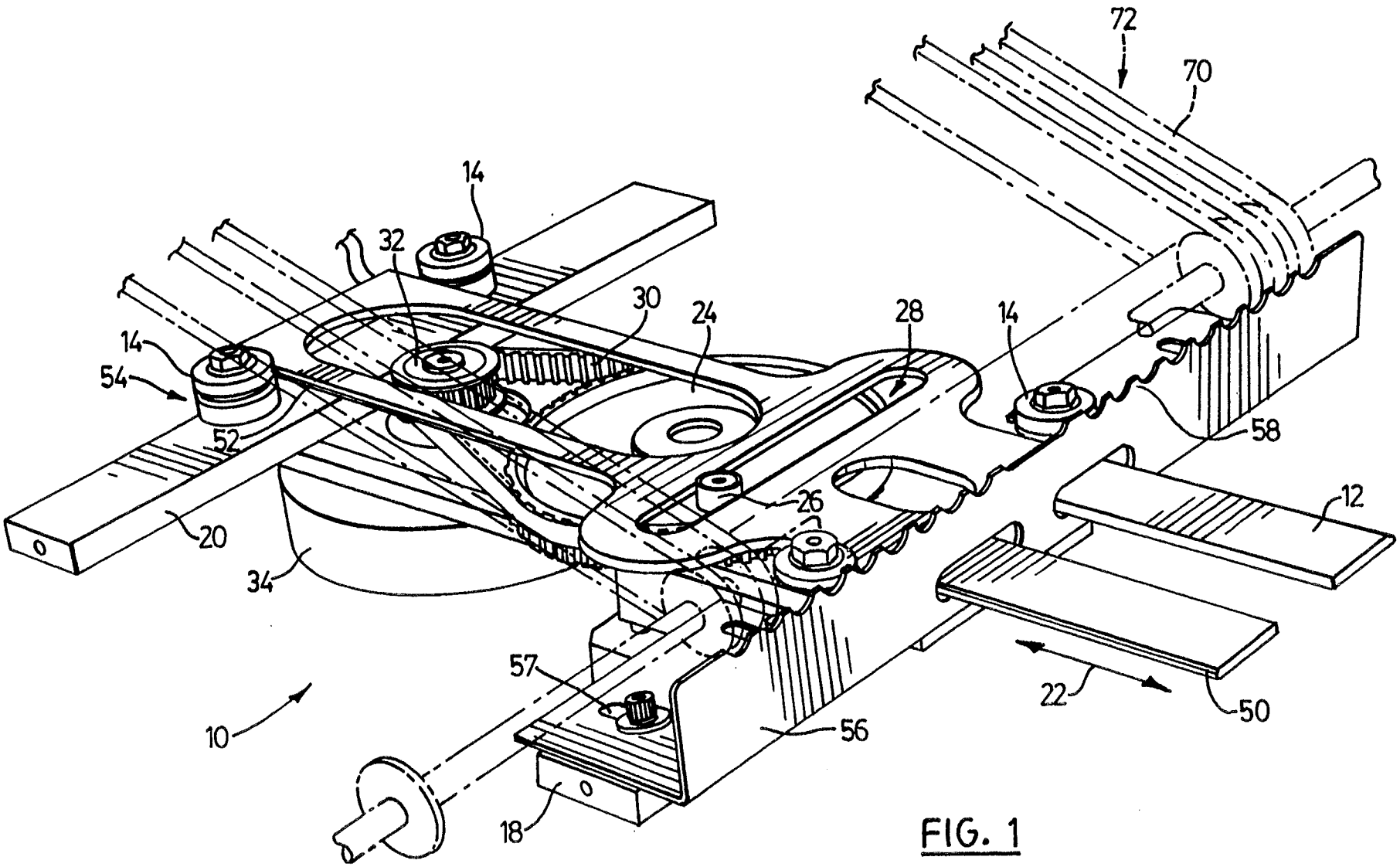
FIG. 1 is a perspective view of a reciprocating table made in accordance with this invention showing a portion of a card or sheet feeder in phantom.
Figure 2:
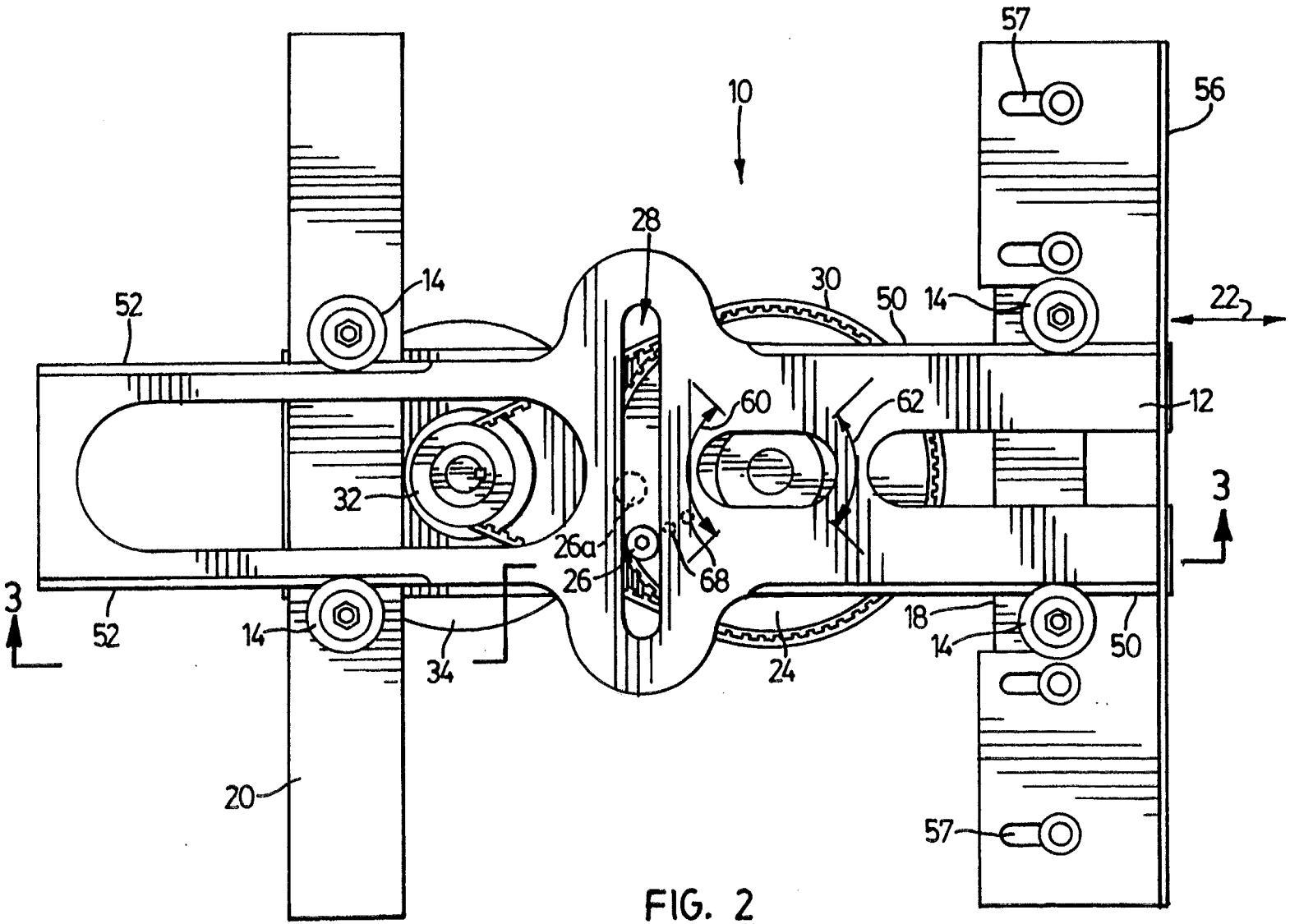
FIG. 2 is a plan view of a reciprocating table made in accordance with this invention.

With reference to FIG. 1 and FIG. 2, a reciprocating table 10 comprises a table element 12 supported for linear reciprocating motion by table guides in the nature of bearings 14. A spaced pair of bearings 14 are rotatably mounted on platform 18 and another spaced pair of bearings 14 are rotatably mounted on platform 20. The bearings guide the table element 12 in a linear path 22.

A cam support 24 is mounted for rotation in a plane parallel to linear path 22. A cam 26 is eccentrically mounted on cam support 24 by way of one of the threaded openings 68 (FIG. 2) in the cam support. Cam 26 is received by a cam follower carried by table element 12 in the nature of slot 28. Cam following slot 28 extends transversely of the linear path 22 for the table element. A belt 30 operatively connects the drive shaft 32 of bi-directional motor 34 to the cam follower 24.

Figure 3:
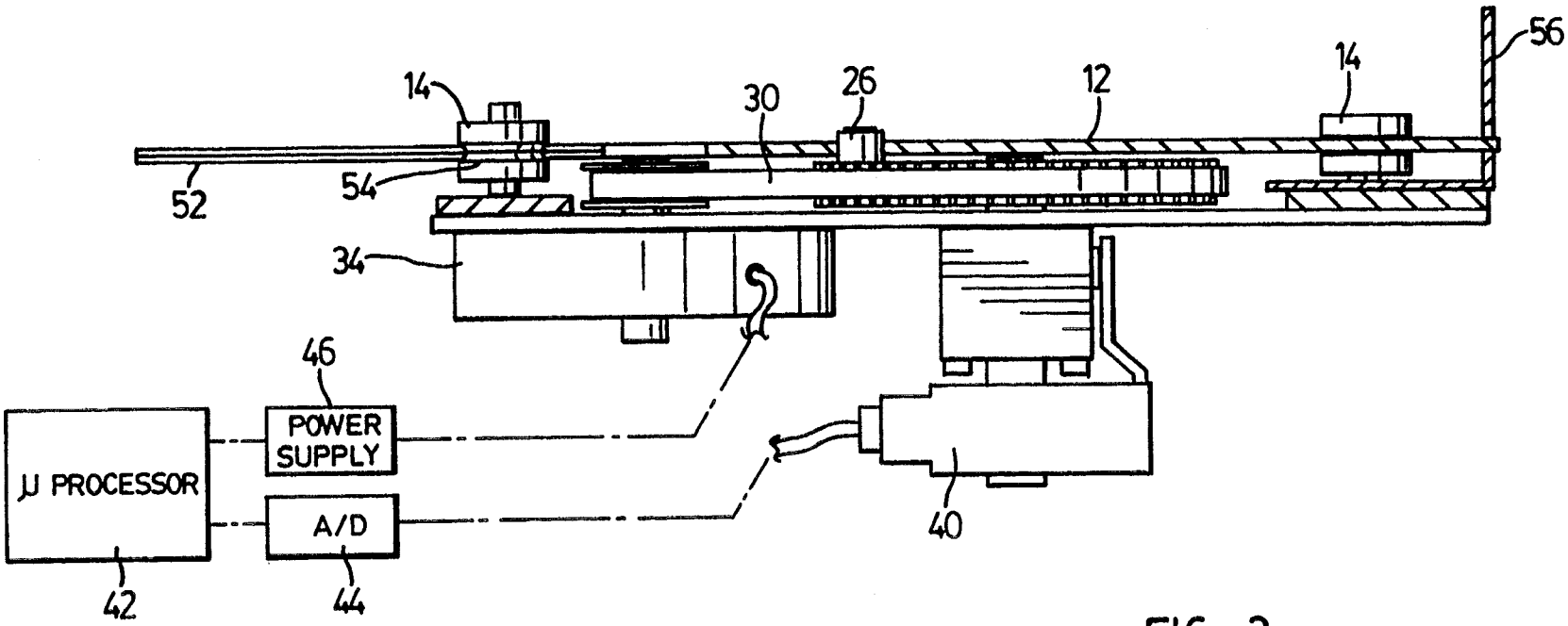
FIG. 3 is a partially cross-sectioned view along the lines 3—3 of FIG. 2 and additionally showing the control apparatus for the reciprocating table.

With reference to FIG. 3, a rotary encoder 40 reads the angular position of the cam support. A microprocessor 42 is connected through analog digital converter 44 to the output of rotary encoder 40. The microprocessor is also connected to the control input of power supply 46 to the bi-directional motor 34.

With reference to all of the figures, it will be noted that the table element 12 has opposite sides with forward knife edges 50 and rearward knife edges 52. Further, with reference to FIGS. 1 and 3, it will be apparent that bearings 14 have V-shaped grooves 54 which receive the knife edges 50, 52.

A stripper 56 is mounted to platform 18. The stripper 56 has an undulating top edge 58 which accommodates belts 70 of the card or sheet feeder 72 illustrated in phantom in FIG. 1. The stripper has slots 57 which allow adjustment of the position of the stripper along path 22.

If the cam support is rotated in one rotational sense from the position of the phantom cam 26*a* shown in FIG. 2, clearly, initially, a large component of the instantaneous velocity of cam is transverse to linear path 22. Thereafter, an increasingly large component of the velocity of the cam is in the direction of the linear path 22 until the cam is instantaneously moving in the same direction as linear path 22. After this point, an increasing component of the velocity of the cam is again transverse to the direction of linear path 22. Accordingly, table element 12 is relatively insensitive to motion of the cam proximate the most retracted and most extended positions of the table and is very responsive to motion of the cam midway between these points when the larger component of the motion of the cam is in the direction of path 22. This fact is utilized to enhance the operation of the reciprocating table, as follows. Rotary encoder 40 apprises microprocessor 42 of the rotational position of the cam support and, therefore, of the position of cam 26. The position of stripper 56 along path 22 is adjusted so that the table is effectively retracted when cam 26 is rotated to any position within a first quadrant 60 which extends through about forty-five degrees of rotation of the cam on either side of the position of phantom cam 26*a*. When the table element 12 is in its retracted position, as defined by cam 26 being anywhere within quadrant 60, microprocessor 42 may operate motor 34 in order to rotate the cam support in one rotational sense (either clockwise or counterclockwise) out of quadrant 60. The cam is then stopped at a position whereat the cam has approached, but has not reached, a quadrant 62 which extends about forty-five degrees on either side of the rotational position of the cam defining the most extended position of the table. This stopped position of the cam defines the extended position of the table. When it is desired to retract the table, the microprocessor reactivates motor 34 such that the cam support rotates in the opposite sense to the direction of rotation of the cam when the table was extended. The microprocessor then stops motor 34 when the cam is somewhere within quadrant 60.

Avoiding quadrant 62 avoids an area whereat the table element 12 is relatively insensitive to motion of the cam. In this way the responsiveness of the reciprocating table is increased. When retracting the table, allowing the cam to enter quadrant 60 permits faster rotation of the cam because (i) the table naturally decelerates in quadrant 60 as an increasing component of the cam vector is transverse to linear path 22 and (ii) the exact stopping position of cam within quadrant 60 is of little importance since the table element 12 is relatively insensitive to motion of the cam within the quadrant.

Preferably, when extending the table, the rotational sense chosen for the cam is that which moves the cam away from the position of phantom cam 26*a* so that the cam does not have to pass through the position of phantom cam 26*a*.

The threaded openings 68 (FIG. 2) in the cam support are at differing radii from the centre of rotation of the support. Accordingly, the eccentricity of cam 26 may be adjusted by mounting the cam to a selected one of the threaded openings 68 in the cam support. In this way, the stroke of the table element 12 may be adjusted.

In operation with a card feeder 72, after table element 12 is extended, feeder 72 feeds a stack of cards or sheets onto table element 12. Feeder 72 is then paused and table element 12 retracts to drop the stack to a downstream handling machine. The table element 12 is then re-extended and the feeder 72 restarted.

Belt 30 could be omitted and cam support 24 and drive shaft 32 provided with meshing spur gears so that the motor may drive the cam support. Other modifications will be apparent to those skilled in the art and, therefore, the invention is defined in the claims.

What is claimed is:

1. A reciprocating table comprising:

table guides for guiding said table in a linear path in a horizontal plane for reciprocation;

a cam support mounted for rotation in a horizontal plane;

a cam eccentrically mounted to said rotatable cam support;

a cam follower carried by said table extending transversely of said linear path;

means to selectively rotate said cam support for selectively extending and retracting said reciprocating table; and a stripper associated with said table into which said table retracts.

2. The reciprocating table of claim 1 wherein said cam support rotation means comprises bi-directional motor means operatively connected to said cam support, means to sense the angular position of said cam support, and means to control said motor means in response to said sensing means.

3. The reciprocating table of claim 2 wherein said table has opposite sides having knife edges in line with said linear path and wherein said table guides comprise bearings with V-shaped grooves receiving said knife edges.

4. The apparatus of claim 1 including means for adjusting the stroke of said cam.

5. A method of reciprocating a table having table guides for guiding said table in a linear path.; a cam support for rotating in a plane parallel to said linear path; a cam eccentrically mounted to said rotatable cam support; and a cam follower carried by said table extending transversely of said linear path, comprising the steps of:

when said cam is within a first quadrant extending about 45 degrees on either side of the rotational position of said cam defining the most retracted position of said table, selectively extending said table by rotating said cam support in a first sense such that said cam moves from said first quadrant to a position whereat said cam has passed a midway point between said rotational position of said cam defining the most retracted position of said table and a rotational position defining the most extended position of said table and has approached, but has not reached, a second quadrant extending about 45 degrees on either said of the rotational position of said cam defining the most extended position of said table and stopping said cam at said second quadrant approaching position; and selectively retracting said table by rotating said cam in a second sense opposite said first sense from said second quadrant approaching position to a position within said first quadrant.

6. The method of claim 5 wherein the extending step comprises rotating said cam from said first quadrant without said cam passing the rotational position of said cam defining the most retracted position of said table.

* * * * *